US008042580B2

(12) United States Patent
Stokes

(10) Patent No.: US 8,042,580 B2
(45) Date of Patent: Oct. 25, 2011

(54) APPARATUS AND METHOD FOR CAPTURING AND CONTAINING SULPHUR HEXAFLUORIDE GAS LEAKAGE

(75) Inventor: Anthony Stokes, Newport (AU)

(73) Assignee: Golden Triangle Enterprises Pty Ltd, Newport (AU)

( * ) Notice: Subject to any disclaimer, the term of this patent is extended or adjusted under 35 U.S.C. 154(b) by 1238 days.

(21) Appl. No.: 11/597,549

(22) PCT Filed: May 16, 2005

(86) PCT No.: PCT/AU2005/000701

§ 371 (c)(1),
(2), (4) Date: Feb. 8, 2007

(87) PCT Pub. No.: WO2005/119120

PCT Pub. Date: Dec. 15, 2005

(65) Prior Publication Data

US 2007/0221285 A1 Sep. 27, 2007

(30) Foreign Application Priority Data

Jun. 2, 2004 (AU) ..... 2004902989

(51) Int. Cl.
*B65B 3/16* (2006.01)
*F17D 5/02* (2006.01)

(52) U.S. Cl. ..... 141/114; 141/10; 141/98; 141/287; 137/15.11

(58) Field of Classification Search ..... 141/10, 141/98, 114, 287, 383, 386; 137/15.11, 312; 73/40, 49.3
See application file for complete search history.

(56) References Cited

U.S. PATENT DOCUMENTS

| | | | | |
|---|---|---|---|---|
| 3,496,963 | A * | 2/1970 | Moody et al. | 138/99 |
| 3,938,774 | A * | 2/1976 | Smith | 249/90 |
| 4,274,851 | A | 6/1981 | Stokes | |
| 4,513,803 | A * | 4/1985 | Reese | 152/427 |
| 5,086,804 | A * | 2/1992 | Ngai | 137/312 |
| 5,333,916 | A * | 8/1994 | Burkit et al. | 285/97 |
| 5,629,065 | A * | 5/1997 | Schinabeck | 428/63 |
| 6,004,377 | A | 12/1999 | Tamata et al. | |
| 6,296,006 | B1 * | 10/2001 | Wegner | 137/15.11 |
| 6,451,206 | B1 * | 9/2002 | Charbonneau | 210/170.09 |
| 7,448,402 | B2 * | 11/2008 | Martrich et al. | 137/15.11 |
| 7,635,007 | B2 * | 12/2009 | D'Auria et al. | 138/99 |
| 2002/0070152 | A1 * | 6/2002 | Charbonneau | 210/170 |
| 2002/0162343 | A1 * | 11/2002 | Herrick et al. | 62/174 |

FOREIGN PATENT DOCUMENTS

JP 9-303699 A 11/1997

OTHER PUBLICATIONS

International Search Report dated Jun. 14, 2005.

* cited by examiner

*Primary Examiner* — Timothy L Maust
(74) *Attorney, Agent, or Firm* — Buchanan Ingersoll & Rooney PC

(57) ABSTRACT

An apparatus and method are provided for capturing and containing $SF_6$ gas leakage from a gas enclosure. The apparatus includes a portage flexible gas storage container of material which is substantially impermeable to $SF_6$ gas. The container includes a gas inlet which is adapted to be coupled in a sealable manner to a surface surrounding a leakage source thereby capturing the $SF_6$ gas in the container. The container inflates under pressure from the captured gas in order to accommodate up to a predetermined capacity of $SF_6$ gas. The apparatus can be adapted to act as a container for transporting $SF_6$ gas from a gas source to an enclosure.

26 Claims, 2 Drawing Sheets

APPARATUS AND METHOD FOR CAPTURING AND CONTAINING SULPHUR HEXAFLUORIDE GAS LEAKAGE

FIELD OF THE INVENTION

The present invention relates to an apparatus and method for capturing and containing $SF_6$ gas leakage.

BACKGROUND OF THE INVENTION

There are a number of industries wherein equipment is required to operate in an atmosphere of sulphur hexafluoride ($SF_6$) gas. One particular industry is the electrical supply industry. $SF_6$ has very low electric conductivity characteristics and so lends itself as being a highly suitable insulating gas for high voltage equipment, for example, electric circuit breakers and transformers.

However, $SF_6$ has serious environmental concerns with respect to its potential contribution to the greenhouse effect if released to the atmosphere. Furthermore, $SF_6$ is an expensive gas to replace if lost to the atmosphere through leakage and, hence, the chance to reclaim it.

For some large indoor installations, measures have been employed to deal with preventing the spread of leaked gas. These measures involve environmental control to confine the spread of gas within a zone surrounding the equipment and means for sealing the zone and containing the gas therein. Such measures are extremely costly to implement and have no application for outdoor installations.

It is an object of the present invention to provide a cost effective alternative for capturing and containing $SF_6$ gas leakage, which can be employed in any installation.

SUMMARY OF THE INVENTION

According to a first aspect of the present invention there is provided an apparatus for capturing and containing sulphur hexafluoride gas leakage from a gas enclosure, said apparatus including:

a portable flexible gas storage container which is substantially impermeable to $SF_6$ gas, said container including a gas inlet, said inlet being adapted to be coupled in a sealable manner to a surface surrounding a leakage source thereby capturing said sulphur hexafluoride gas in said container, said container being inflatable under pressure from the captured gas in order to accommodate up to a predetermined capacity of sulphur hexafluoride gas.

According to a second aspect of the present invention there is provided a method for capturing and containing sulphur hexafluoride gas leakage from a gas enclosure, said method including the steps of:

providing a portable flexible gas storage container which is substantially impermeable to $SF_6$ gas, said container including a gas inlet;

coupling said inlet in a sealable manner to a surface surrounding a leakage source; and capturing said sulphur hexafluoride gas in said container, wherein said container inflating under pressure from the captured gas and accommodating up to a predetermined volume of sulphur hexafluoride gas.

The present invention advantageously provides an efficient form of capturing and containing $SF_6$ gas leakage. The portability of the apparatus conveniently allows the apparatus to be stored on-site and moved, when required, directly to the source of the leak. The apparatus conveniently allows captured gas to be stored until subsequently needed, for example, to perform $SF_6$ recovery.

One significant economic advantage is that, by capturing the leaked gas, the captured gas can be subsequently recovered and potentially be re-used. An appropriate $SF_6$ recovery system which employs cryogenic processes is described in U.S. Pat. No. 4,274,851, which is herein incorporated by reference. Such a recovery system has a convenient assembly which can be usefully provided on-site.

According to a further aspect of the present invention there is provided an apparatus for containing and transporting sulphur hexafluoride gas from a gas source to a gas enclosure, said apparatus including:

a portable flexible gas storage container of material which is substantially impermeable to sulphur hexafluoride gas, said container including a gas inlet, said inlet being adapted to be coupled in a sealable manner to a gas source thereby capturing said sulphur hexafluoride gas in said container, said container being inflatable under pressure from the captured gas in order to accommodate up to a predetermined capacity of sulphur hexafluoride gas, said inlet being further adapted to be uncoupled from said gas source and sealed thereby retaining captured sulphur hexafluoride in said container for transportation.

BRIEF DESCRIPTION OF THE DRAWINGS

Further features and aspects of the present invention will become apparent from the following description of preferred embodiments given in relation to the accompanying drawings, in which.

DESCRIPTION OF PREFERRED EMBODIMENT

Figure 1:
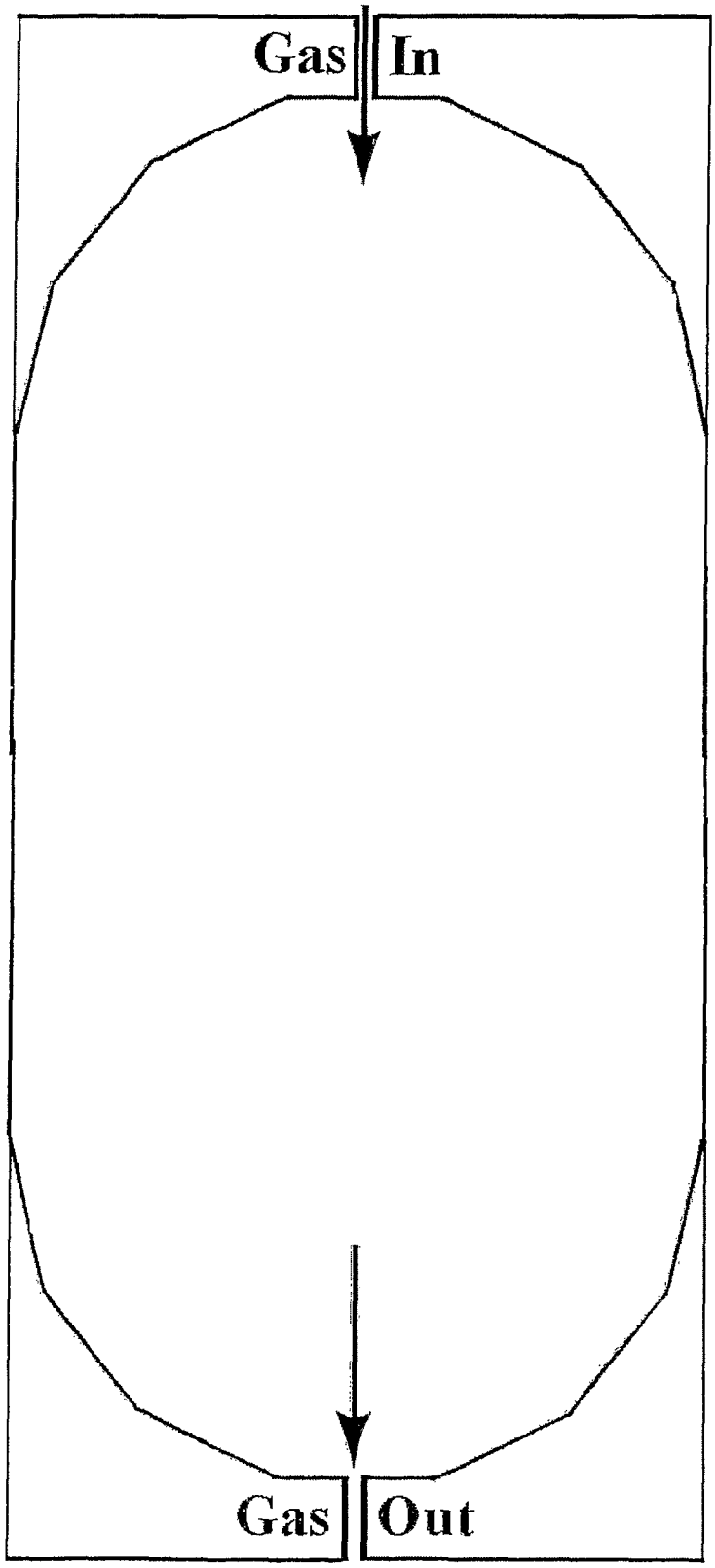
FIG. 1 is a plan view of a preferred embodiment of a container in a non-use state.

According to a preferred embodiment of the present invention, an apparatus is provided in the form of a portable flexible gas storage container. The container has a spherical or elongated tubular construction and includes a gas inlet. The container is formed from material which is substantially impermeable to $SF_6$ gas. Examples of suitable material include low density polyethylene and PVC sheeting. Successful embodiments have been fabricated using polyethylene sheeting of 3 microns thickness. FIG. 1 shows a diagram of such an embodiment being a tube of polyethylene sheet laid flat. In its flat presentation the sheet has a width of 2 m and a length up to 25 m. The length defines the gas capacity. The lines shown in FIG. 1 correspond with plastic sheet weld lines between overlapping sheets, designed to create a tubular shape when inflated, and with gas inlet and outlet apertures at either end.

Figure 2:
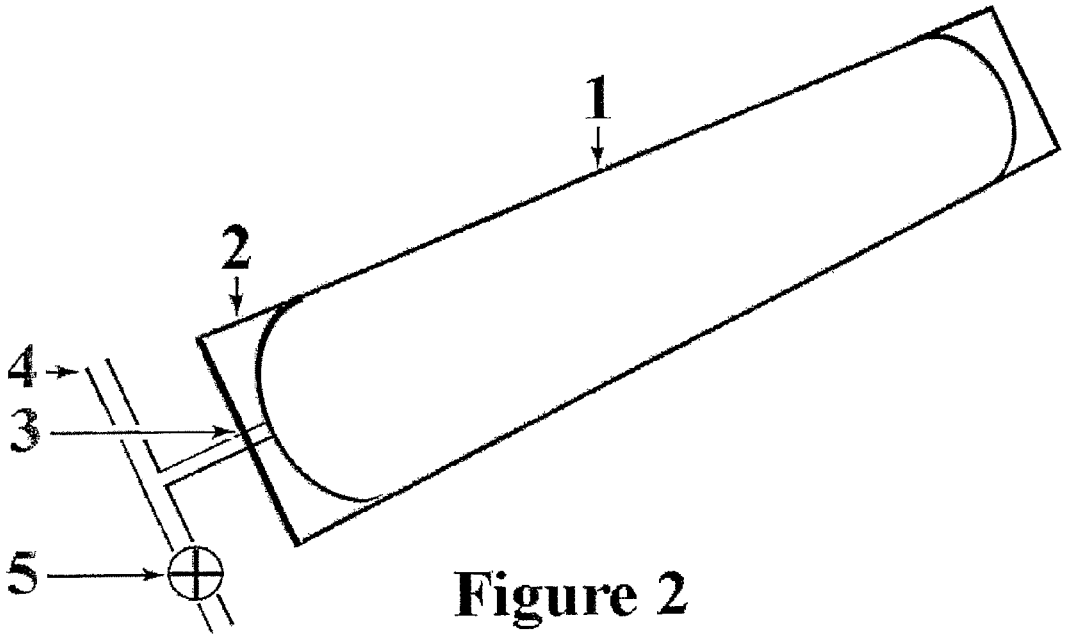
FIG. 2 is a view of an alternative embodiment of a container in use.

FIG. 2 shows an alternative embodiment, in an inflated state, having only one inlet/outlet aperture 3. This embodiment is particularly suitable for use in a large high voltage substation. The container has a main tubular inflatable section 1 and flat end portions. Flat end portion 2 includes the inlet/outlet aperture 3. The container is illustrated with a gas inlet/outlet pipe attachment 4 connected to the inlet/outlet aperture 3. The attachment 4 may include a valve 5 which can be used to control extraction of captured gas from the container.

When not in use, the container can be conveniently stored in the form of a roll. However, the container could be stored in other configurations provided the container is empty, whereby the walls are substantially flat against one another.

In a gas leak situation, once the leakage source has been discovered, the inlet to the attachment 4 can be connected and sealed in a substantially gas tight manner to a surface surrounding the leakage source. It is anticipated that instead of using an attachment 4, the inlet/outlet aperture 3 of the container could be connected and sealed in a substantially gas tight manner directly to a surface surrounding the leakage source. This could be achieved by simply taping the inlet to the surface using self adhesive tape or similar. Once sealed, the leakage is captured inside the container. The container will then inflate under the pressure of the captured gas. The container is then left to capture the leaked gas until it reaches maximum capacity or the leakage is stopped. It is noted that such leaks are generally slow, and in many cases the total volume of gas is not large. However, the value of the gas is such that capture is often economic so that the captured gas can be subsequently recovered by using an $SF_6$ gas recovery system. Even in situations of low leakage rate the newly recognised environmental impact of the leaked gas is such that limiting atmospheric release is now a key aim of many users of $SF_6$ insulated equipment and in many countries is also government policy.

The maximum gas capacity of the container would be selected to accord with the gas capacity of on-site equipment. High-voltage electrical equipment would often operate with $SF_6$ quantities typically in the range of 5 kg to 200 kg, although both smaller and larger quantities are in use. Tests have found that single containers can be made to adequately accommodate such volumes. Some specialized applications can involve up to, and sometimes exceed, 5000 kg in which case multiple containers can be manifolded together with a common gas inlet to deal with these quantities. This common gas inlet would then be directly coupled in a sealable manner to the surface surrounding the leakage source. In each potential application the quantities of gas involved can usually be predetermined to ensure adequate storage capacity can be provided on site.

Once the leakage has ended or stopped, the container can be sealed until a suitable means for reclaiming the gas becomes available. In some applications, such as illustrated in FIG. 1, the gas may be reclaimed directly from the container via a separate gas outlet whilst it continues to perform its task of leakage capture via the inlet. Such gas reclaiming equipment is usually constructed from metallic pipework that does not lend itself to enveloping a leakage source. Preferrably, the inlet may include a valve for sealing the captured gas within the container and allowing the inlet to be uncoupled from the leakage source.

It will be appreciated that numerous modifications can be made to the form of the apparatus described above subject to falling within the scope of the annexed claims. For example, the inlet of the container may be provided with different shapes or arrangements which are suitable for direct coupling to different leakage source locations and allow the inlet to better envelop the leakage source. Alternatively the inlet may be connected to flexible tubing, thereby permitting multiple inputs and outputs with valves to control the flow of gas, for example, from the leaking site and to a reclaiming facility. In such a case the flexible tubing would itself be connected to a similar but separate means of sealably enveloping the leakage source to ensure that the inlet is indirectly coupled in a sealable manner with the leakage source.

The embodiment described above related to the application of capturing $SF_6$ gas in a leakage situation. It is anticipated that the apparatus could be adapted for other purposes. In particular, the transportation of $SF_6$ gas from a gas source, such as a supply depot, to a gas enclosure requiring $SF_6$ gas, such as a high voltage substation. In such an application, the gas inlet would need to be sealable, for example by way of a valve, so that after capturing gas from the gas source the container can be transported to the gas enclosure.

The invention claimed is:

1. An apparatus for capturing and containing sulphur hexafluoride gas leakage from high voltage equipment, said apparatus comprising:

at least one portable flexible gas storage container of material which is substantially impermeable to sulphur hexafluoride gas, said container including a gas inlet, said inlet for coupling in a sealable manner to a surface surrounding a leakage source thereby capturing said sulphur hexafluoride gas in said container, said container being inflatable under pressure from the captured gas in order to accommodate up to a predetermined capacity of sulphur hexafluoride gas;

wherein said inlet is uncoupledable from said surface and sealable in order to retain said captured gas within the container.

2. The apparatus according to claim 1, wherein said container has a substantially spherical or tubular construction.

3. The apparatus according to claim 1, wherein said container has a normally substantially flat configuration when not in use.

4. The apparatus according to claim 1, wherein said container is capable of being rolled, when not in use, for convenience of storage.

5. The apparatus according to claim 1, wherein said container includes a normally sealed gas outlet, which can be unsealed to remove captured sulphur hexafluoride gas from said container.

6. The apparatus according to claim 1, wherein said material which is substantially impermeable to sulphur hexafluoride gas is of polyethylene construction or PVC sheeting.

7. The apparatus according to claim 1, wherein the high voltage equipment is one of an electric circuit breaker, a transformer or a high voltage substation.

8. The apparatus according to claim 1, comprising:

a plurality of inlets, each being suitable for coupling to different leakage source locations.

9. The apparatus according to claim 1, further comprising:

flexible tubing for connecting the inlet and including a plurality of valves to control a flow of gas.

10. The apparatus according to claim 1 comprising:

a plurality of portable flexible gas storage containers of material which is substantially impermeable to sulphur hexafluoride gas, said plurality of containers manifolded together, said plurality of containers being inflatable under pressure from the captured gas in order to accommodate up to a predetermined capacity of sulphur hexafluoride gas.

11. The apparatus according to claim 1, further comprising:

a valve for opening and closing the inlet.

12. A method for capturing and containing sulphur hexafluoride gas leakage from high voltage equipment, said method comprising:

providing a portable flexible gas storage container which is substantially impermeable to sulphur hexafluoride gas, said container including a gas inlet;

coupling said inlet in a sealable manner to a surface surrounding a leakage source;

capturing said sulphur hexafluoride gas in said container, said container inflating under pressure from the captured gas and accommodating up to a predetermined volume of sulphur hexafluoride gas;

uncoupling said inlet from said surface; and sealing said inlet, thereby retaining said captured gas in said container.

13. The method according to claim 12, wherein said container has a substantially spherical or tubular construction.

14. The method according to claim 12, wherein said container has a normally substantially flat configuration when not in use.

15. The method according to claim 12, including the step of rolling said container, when not in use, for convenience of storage;

wherein said providing step includes providing said container in the form of a roll.

16. The method according to claim 12, wherein said coupling step includes taping said inlet directly to said surface in a substantially gas tight manner.

17. The method according to claim 12, further including the step of removing said captured sulphur hexafluoride gas from said container via a gas outlet.

18. An apparatus for containing and transporting sulphur hexafluoride gas from a gas source to high voltage equipment, said apparatus comprising:

a portable flexible gas storage container of material which is substantially impermeable to sulphur hexafluoride gas, said container including a gas inlet, said inlet for coupling in a sealable manner to a gas source thereby capturing said sulphur hexafluoride gas in said container, said container being inflatable under pressure from the captured gas in order to accommodate up to a predetermined capacity of sulphur hexafluoride gas, said inlet being uncoupledable from said gas source and sealable thereby retaining captured sulphur hexafluoride gas in said container for transportation.

19. The apparatus according to claim 18, wherein said container has a substantially spherical or tubular construction.

20. The apparatus according to claim 18, wherein said container has a normally substantially flat configuration when not in use.

21. The apparatus according claim 18, wherein said container is capable of being rolled, when not in use, for convenience of storage.

22. The apparatus according to claim 18, wherein said container includes a normally sealed gas outlet, which can be unsealed to allow transfer of captured sulphur hexafluoride gas from said container to said gas enclosure.

23. The apparatus according to claim 18, wherein said material which is substantially impermeable to sulphur hexafluoride gas is of polyethylene construction.

24. The method according to claim 12, wherein the high voltage equipment is one of an electric circuit breaker, a transformer or a high voltage substation.

25. The apparatus according to claim 18, wherein the high voltage equipment is one of an electric circuit breaker, a transformer or a high voltage substation and the gas source is a supply depot.

26. The method according to claim 12, comprising:

re-using the captured sulphur hexafluoride gas captured in the container in another application.

* * * * *